US011558689B2

(12) United States Patent
Plummer

(10) Patent No.: US 11,558,689 B2
(45) Date of Patent: Jan. 17, 2023

(54) ACOUSTIC ADAPTER FOR A LOUDSPEAKER DRIVER

(71) Applicant: TBI Audio Systems LLC, Rockville, MD (US)

(72) Inventor: Jan Plummer, Marietta, GA (US)

(73) Assignee: TBI Audio Systems LLC, Marietta, GA (US)

( * ) Notice: Subject to any disclaimer, the term of this patent is extended or adjusted under 35 U.S.C. 154(b) by 35 days.

(21) Appl. No.: 17/238,611

(22) Filed: Apr. 23, 2021

(65) Prior Publication Data

US 2022/0345809 A1 Oct. 27, 2022

(51) Int. Cl.
*H04R 1/28* (2006.01)
*H04R 25/00* (2006.01)

(52) U.S. Cl.
CPC ..... *H04R 1/2803* (2013.01); *H04R 1/2823* (2013.01); *H04R 25/604* (2013.01)

(58) Field of Classification Search
None
See application file for complete search history.

(56) References Cited

U.S. PATENT DOCUMENTS

2003/0174851 A1* 9/2003 Plummer ..... H04R 1/2819 381/345
2007/0284183 A1* 12/2007 Whitaker ..... H04R 1/025 181/150
2010/0142741 A1* 6/2010 Plummer ..... H04R 1/2857 381/345

* cited by examiner

*Primary Examiner* — Mark Fischer
(74) *Attorney, Agent, or Firm* — Emerson, Thomson & Bennett, LLC

(57) ABSTRACT

Provided in this disclosure is an acoustic adapter which includes an interior enclosure for substantially surrounding a back of a speaker driver and for defining a predetermined three-dimensional interior volume (3DV1) around the back of the speaker driver to thereby act as a vibration dampener. An exterior enclosure is provided having a configuration that corresponds to a configuration of the interior enclosure and spaced apart from the interior enclosure to define a restricted two-dimensional volume (2DV) outside the three-dimensional interior volume. An aperture is formed in the interior surface of the enclosure for admitting sound into the two-dimensional volume. A foam material is received within the two-dimensional volume (2DV) for at least coating an inner surface of the exterior enclosure, to provide a frictional surface for damping the sound admitted into the two-dimensional volume.

14 Claims, 6 Drawing Sheets

ACOUSTIC ADAPTER FOR A LOUDSPEAKER DRIVER

I. BACKGROUND

A. Technical Field

This invention pertains to the field of audio speakers. In particular, the invention pertains to audio distortion that results in speakers, and the reduction of the factors that contribute to the audio distortion

B. Description of Related Art

Typical dynamic speaker drivers are housed in an enclosure such as a speaker cabinet or the like, as required to construct and market the device. The purpose of this enclosure, other than to provide visual aesthetics, is to isolate the front and rear of the driver diaphragm. These areas must be isolated to prevent inherent cancellations of the sound by simultaneous high and low pressure fields generated by the diaphragm. This creates issues associated with broadband signals. In creating sounds with a loudspeaker diaphragm, a single tone can be created without reference to other tones. However, there is little practical use for single tone audio signals except for test purposes. In practical loudspeaker usage, many different signals are always generated to convey audio information. It is desirable to use a single driver in most mass applications of sound reproduction, especially in modern systems of small and narrow dimensions. The single driver must produce a wide audio range (full range) to include all but the deepest bass frequencies. Supporting lower bass frequencies in a room typically require a larger diaphragm with a separate power source (i.e., a subwoofer). Modern sound reproduction for entertainment typically provides a sound frequency range of 80 Hz to 20 kHz. The speaker drivers typically used are 3" or less (typically oval shaped) as required for full range operation. In all loudspeaker systems the requirements of isolating and housing the speaker driver are a principal cause of poor sound quality.

A physical problem with loudspeaker technology has been reproducing broadband sound without encountering various types of audible distortion. The electronic audio signals inputted into a speaker are typically pristine with minimal non-linearity. Distortion can arise from the physical environment in which the speaker operates. As the speaker driver oscillates in transduction of the electrical audio signal, it encounters pressure differentials within the speaker cabinet and the ambient air. Thermal turbulence in the form of eddies, currents and vortices within the air are produced by the speaker and the accompanying electronics. This thermal turbulence generates a range of widely varying pressure conditions and other fluid dynamical forces that act upon the speaker driver, which can impede the velocity of the oscillation of the speaker diaphragm and thus the transduction of the pristine electronic audio signal, resulting in distortion of the sound. Moreover, this distortion is worsened off-axis from the center of the speaker.

The waves of sound have a real length in their ambient pressure environment. The length of sound waves behind a typical loudspeaker driver in its application varies considerably in a non-linear manner. While the ambient air supports an accurate length of well-established natural sounds, the loudspeaker also presents non-linear sounds representing distortion generated within its enclosed space to the ambient.

This phenomenon as described by current physical laws is deemed insurmountable in the field of conventional speaker technology. As a result there is an industry standard to accept unacceptable sound quality in most applications other than high-end devices requiring sound reproduction.

II. SUMMARY

The present invention as described herein provides an acoustic adapter having a required enclosed space that is minimal relative to the depth of a speaker driver while supporting the wavelengths and levels produced by the velocity profile of the driver. The acoustic adapter of the present invention enables a loudspeaker to achieve sonic accuracy by achieving critical damping for its bandwidth.

The present invention provides an acoustic adapter which improves over the prior art by including a two-dimensional (2D) enclosure or module placed within an enclosure to control pressure variations behind the speaker driver. Surprisingly, it has been found that there is an optimum volume for a specific speaker driver along with an associated 2D volume in order to manage the thermals induced by the pressure. The present invention as described herein eliminates the concern for the enclosed volume of the final product and provides an associated 2D isothermal control volume. The present invention produces proper acoustic performance for the driver regardless of the final product dimensions. In one example, a tower speaker is typically tall to express its full uncompromising vertical presentation. However, with the inclusion of an acoustic adapter according to the present invention, the speaker tower does not have to be deep. The performance of the speaker is much improved in accuracy with critical damping, thereby achieving high-definition sound.

In supporting the natural required velocities, an isothermal environment is produced within an isolated 3D/2DT (Turbulent) volume enclosed by the adapter. These volume ratios are consistent with the driver's requirements for broadband critical damping. Maintaining the proper pressure environment in response to level and bandwidth is the goal. The velocity profile of the input electrical signal will determine the change in position and speed of the diaphragm as necessary for low distortion and a natural acoustic presentation. The frequency of the signal provides the acoustic mass required to maintain accuracy of velocity.

The use of small drivers to satisfy the needs meets the theoretical requirements of a point source to assure proper high frequency dispersion at required angles relative to the driver's acoustic output on axis. The present acoustic adapter allows the driver to approach its theoretical performance.

In accordance with the aforementioned description, the present invention as described herein provides an acoustic adapter which includes an interior enclosure for substantially surrounding a back of a speaker driver and for defining a predetermined three-dimensional interior volume (3DV1) around the back of the speaker driver to thereby act as a vibration dampener. An exterior enclosure is provided having a configuration that corresponds to a configuration of the interior enclosure and spaced apart from the interior enclosure to define a restricted two-dimensional volume (2DV) outside the three-dimensional interior volume. An aperture is formed in the interior surface of the enclosure for admitting sound into the two-dimensional volume. A foam material is received within the two-dimensional volume (2DV) for at least coating an inner surface of the exterior enclosure, to provide a frictional surface for damping the sound admitted into the two-dimensional volume.

The present acoustic adapter can also include a second three-dimensional volume (3DV2) outside an exterior surface of the exterior enclosure. The second three-dimensional volume (3DV2) is preferably a larger volume than the predetermined three-dimensional volume (3DV1) and thereby defines a more regulated air pressure. The acoustic adapter can also include one or more dynamic pressure isolators formed in the interior and exterior enclosures, for providing communication of the regulated pressure between the second three-dimensional volume (3DV2) to the predetermined three-dimensional volume (3DV1) to magnify low frequency output in conjunction with a port.

The foam material inside the 2D volume is preferably friction-enhancing open cell foam that lines the inner surface of the exterior enclosure. The foam material substantially occupies 50% of the two-dimensional volume.

The aperture of the acoustic adapter is centered behind the speaker driver on the interior enclosure. The aperture has an aperture size and aperture shape selected according to a frequency range of the speaker driver, wherein the aperture size comprises a larger portion of the interior surface when used with a lower frequency speaker driver and a smaller portion of the interior surface when used with a higher frequency speaker driver.

The interior and exterior enclosures of the acoustic adapter have a configuration that can be either round, oval, square, or rectangular. The two-dimensional volume has a dimensional area (x, y) that conforms to dimensions of the speaker driver and a volume dimension (z) restricted to a fixed value selected according to a frequency range of the speaker driver, wherein a larger volume dimension (z) is selected for a lower frequency speaker driver and a smaller volume dimension (z) is selected for a higher frequency speaker driver, wherein the volume dimension (z) is selected to provide a desired sound quality (Q).

In an alternative embodiment, the two-dimensional volume can include one or more additional subdivided two-dimensional volumes each having a respective individual aperture. Each of the additional subdivided two-dimensional volumes correspond to a selected predetermined frequency and can be sized and dimensioned accordingly to selectively provide damping at the respective frequencies associated with the volumes. The additional subdivided two-dimensional volumes and respective individual apertures can be located at a respective point away from the aperture formed in the interior surface of the enclosure. In one aspect, one or more of the additional subdivided two-dimensional volumes having respective individual apertures can be an internal two-dimensional volume fabricated internally in between the interior and exterior enclosures. Alternatively, one or more of the additional subdivided two-dimensional volumes having respective individual apertures can be an external two-dimensional volume affixed to an outside surface of the internal enclosure.

In a further alternative embodiment, a balanced armature acoustic adapter can be provided including a first enclosure for substantially surrounding a back of a balanced armature driver and for defining a predetermined three-dimensional interior volume (3DV1) around the back of the balanced armature driver to thereby act as a vibration dampener. A tube is provided for carrying sound from the balanced armature driver to an opposite end of the tube. A second enclosure is affixed to the tube in parallel at a location downstream of the balanced armature driver, wherein the enclosure defines a restricted two-dimensional volume (2DV) outside the three-dimensional interior volume. An aperture is formed in the tube for admitting sound into the two-dimensional volume, for managing weaker reactive pressures in the tube. A foam material is received within the two-dimensional volume (2DV) for at least coating an inner surface of the exterior enclosure, to provide a frictional surface for damping the sound admitted into the two-dimensional volume. A virtual second three-dimensional volume (3DV2) is formed in a portion of the tube including the opposite end. In the preferred embodiment, the balanced armature driver is a component in a hearing aid where the tube carries the sound from the balanced armature driver to an ear canal of a wearer of the hearing aid.

According to an aspect of the invention, the present acoustic adapter optimizes system loading to achieve critical damping of the broadband out of the driver.

According to another aspect of the invention, the present acoustic adapter enables a speaker to reproduce sound with definition comparable to modern high definition video.

Other benefits and advantages of this invention will become apparent to those skilled in the art to which it pertains upon reading and understanding of the following detailed specification.

III. BRIEF DESCRIPTION OF THE DRAWINGS

The disclosed acoustic adapter may take physical form in certain parts and arrangement of parts, embodiments of which will be described in detail in this specification and illustrated in the accompanying drawings which form a part hereof and wherein:

FIGS. 4A and 4B are graphs indicating on-axis and off-axis audio fidelity for a speaker according to FIG. 2B when respectively used without the acoustic adapter and with the acoustic adapter in accordance with the second additional exemplary embodiment of the present invention.

IV. DETAILED DESCRIPTION

Figure 1A:
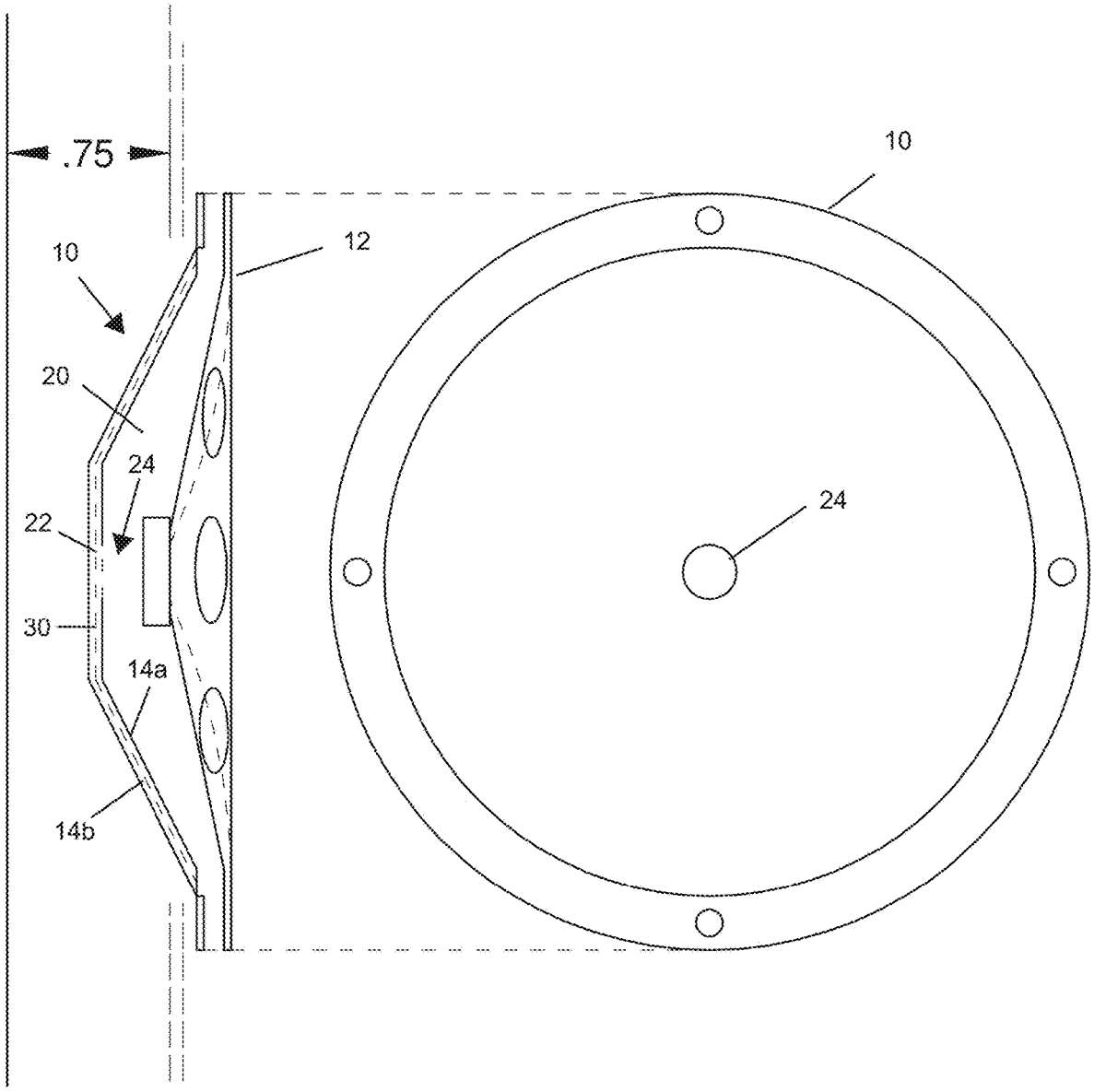
FIGS. 1A and 1B are side sectional and front views respectively showing a speaker driver with an acoustic adapter, and alternatively showing the same with multiple two-dimensional volumes in accordance with exemplary embodiments of the present invention.

Referring now to the drawings wherein the showings are for purposes of illustrating embodiments of the article only and not for purposes of limiting the same, and wherein like reference numerals are understood to refer to like components:

With reference to FIG. 1A, the aforementioned problems encountered in the prior art are overcome with the acoustic adapter 10 of the present invention. The acoustic adapter 10 is a structure used to house a speaker driver 12 and adds minimum additional depth to the driver 12. The adapter 10 solves the conventional problem associated with sound cancellation by isolating the front and rear of the driver 12. The adapter 10 also solves additional problems by providing an interior enclosure 14*a* and an exterior closure 14*b*. The interior closure 14*a* substantially surrounds the back of the speaker driver 12. The interior closure 14*b* thereby defines a predetermined three-dimensional interior volume (3DV1) 20 around the back of the speaker driver 12. The exterior enclosure 14*b* has a shape or configuration that closely corresponds to the shape or configuration of the interior enclosure 14*a*.

With further continued reference to FIG. 1A, the exterior enclosure 14*b* is spaced apart from the interior enclosure 14*a* at a precise constant distance to define a restricted two-dimensional volume (2DV) 22 in the space between the enclosures 14*a*, 14*b*, outside the three-dimensional interior volume 20. An aperture 24 is formed in the interior surface 14 of the enclosure for admitting sound into the two-dimensional volume 22. The two-dimensional volume 22 has a dimensional area (x, y) that conforms to the dimensions of the speaker driver 12 and a volume dimension (z) restricted to a fixed value selected according to a frequency range of the speaker driver. It has been determined empirically that a larger volume dimension (z) is selected for a lower frequency speaker driver and a smaller volume dimension (z) is selected for a higher frequency speaker driver. Based on this empirical determination process, the volume dimension (z) is selected to provide a desired sound quality (Q).

With still further continued reference to the adapter 10 shown in FIG. 1A, it is believed that a physics phenomenon termed "two-dimensional turbulence" (2DT) is responsible for the superior empirical results obtained. It has been found that the best results are obtained by determining a suitable ratio between the 2D volume 22 and the 3D volume 20, however the process of determining that ratio remains empirical at this time. Further subsequent work will be undertaken to formally study these results to better understand the underlying physical cause. The electro-acoustic specifications of the driver 12 and the available 3D volume 20 for a given speaker application is used to determine the dimensional volume of the reactive 2D volume 22. These variables allow for the completion of a viable environment for proper isothermal operation of the driver piston.

The following is a discussion of the present understanding of the phenomenon that produces the surprising empirical results. An internal/external boundary layer is defined at solid surfaces at the periphery of the 3D volume 20. The internal/external boundary layer is created when one side of a surface is enclosed fully. There is a fixed boundary and a virtual boundary. The fixed boundary establishes an internal volume in which the audio range of the piston of the speaker driver 12 loads with pressure on each oscillation. The virtual boundary is created by isothermal management of this pressure loading. The boundary is deemed "virtual" where it results in all wavelengths being terminated. This is accomplished by managing this pressure relative to wavelength and pressure level.

In a typical system, within the confined 3D volume 20 enclosed by the boundary there is no way to regulate internal pressures exerted against the internal boundary layers. This causes alteration of the velocity profile of the speaker driver 12 which is established by the electrical audio signal. The 2D volume 22 is a narrow profiled volume in which the z (height) dimension is restricted to a small value. The z dimension is empirically determined for a specific speaker in ratio with the other dimensions but is maintained to a height that is discovered to result in optimum scrubbing or damping of sound along its friction enhanced boundary surface. For this reason, a foam material 30 is received within the 2D volume 22, as also depicted in FIG. 1A. The foam material 30 is used at least for coating an inner surface of the exterior enclosure 14, where the inner surface is within the 2D volume 22. In this manner, the foam material 30 provides a frictional surface for damping the sound admitted into the 2D volume 22.

With further continued reference to FIG. 1A, the opening or aperture 24 is an entrance for sound to be admitted into the 2D volume 22. The size and shape of the aperture 24 is empirically selected to be of non-resonate dimensions for a specific reference sound frequency. The aperture 24 enables the 2D volume to communicate directly with the pressure variations created in the 3D volume 20 and thereby create coherent vortices that dissipate energy at the boundary layers. The instantaneous application of pressure allows the 2D volume 22 to maintain a proper pressure/volume relationship through heat dissipation at the 2D internal boundary layers. A minimal open-air surface is defined along the z dimension opposite the boundary layer. Heat dissipation in the 2D volume 22 is enhanced using the foam material 30 having a rough surface to enhance vorticity in the 2D volume 22. In this way, the pressure variations and turbulence within the 3D volume 20 are mitigated thereby resulting in a laminar flow behind the speaker driver 12 with proper velocity for the diaphragm/piston, thus resulting in critical damping—where pressure variations around the speaker are not too large or small but the precise critical amount.

With respect to the variable sizes of the aperture 24, typically a large 3D volume 20 with a large aperture 24 is more responsive to the lower range audio frequencies while a small 3D volume 20 with a small aperture 24 is are responsive to higher range audio frequencies. Large volumes terminate longer waves in response to the range of the main coherent vortices. The coherent vortices responsible for dissipating their appropriate bandwidths are larger or smaller in response to these dimensions. Additional smaller volumes provide linearity of acoustic loading for the full range driver.

A typical full range driver has worsening dispersion with increased distance from the speaker axis, which hampers high-fidelity performance. Fidelity is defined as the ability of the internal drivers to respond to specific waves in its bandwidth with proper speaker diaphragm velocity profiles. The present invention provides an enclosed isothermal thermodynamic 3D volume 20 with an included 2D turbulent volume where 2D turbulence is understood to be responsible for establishing coherent vortices that are forced when pressure enters the aperture 24 into the 2D volume 22. The 2D volume 22 may be subdivided to influence the pressure behavior specific to a range of frequencies applied to the driver whereas the electro-mechanics of the driver are not linear with frequency.

With continued reference to FIG. 1A, the 2D volume 22 establishes an isothermal 3D environment for the broadband vibrations of the driver diaphragm. The driver 12 has a dimensional limitation restricting response in the lower ranges. However, the lower information is acoustically processed to minimize rapid response roll-off following the driver's intended range. This results in improved velocity linearity and dispersion in the higher ranges. In the preferred embodiment, the adapter 10 includes enclosure structures for at least one 2D volume 22 but can be supplemented with additional 2D volumes responsive to specific ranges of frequencies such as high frequencies or mid frequencies.

Figure 1B:
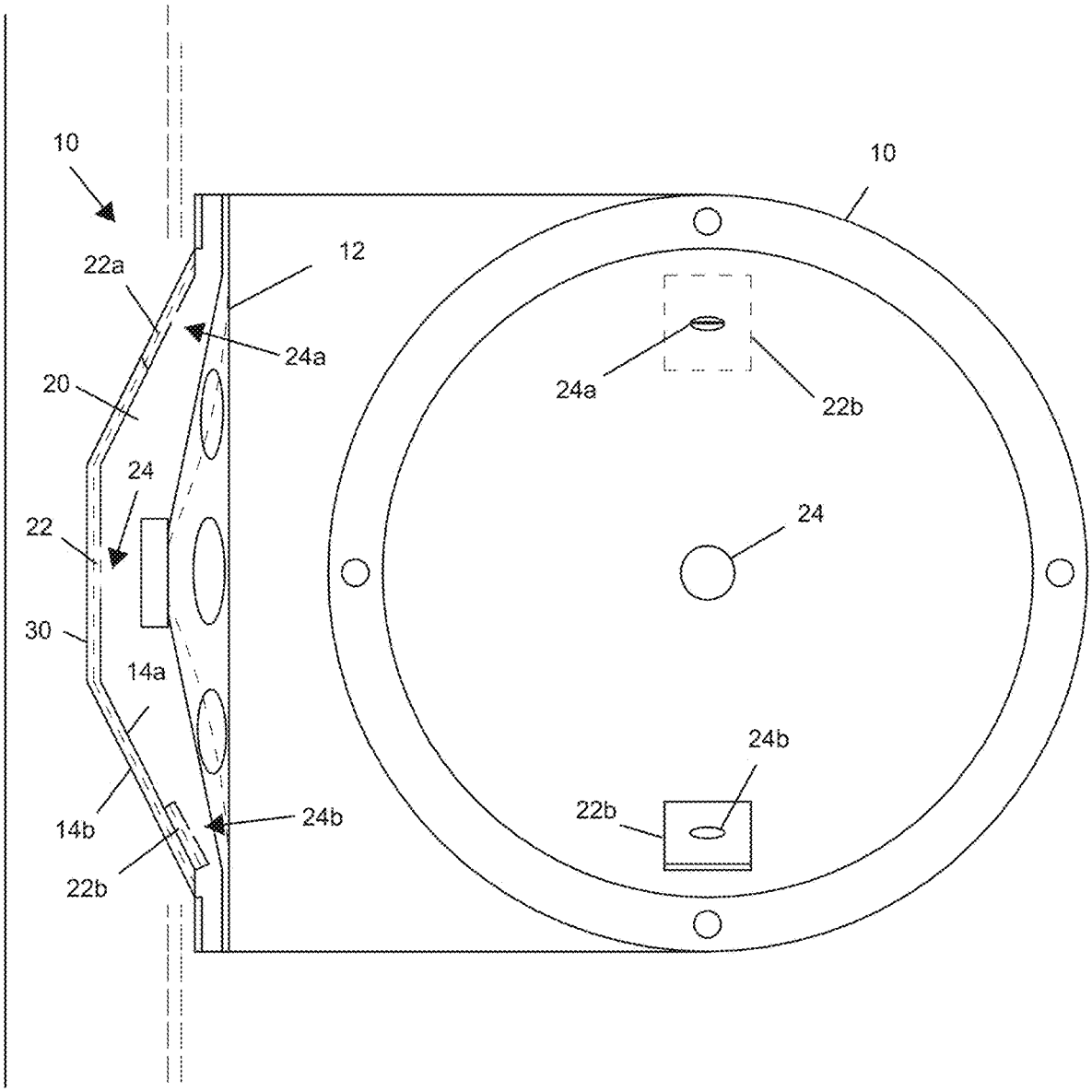

FIG. 1B depicts an alternative embodiment having the same structure and components having the same reference numerals as depicted in FIG. 1A, only differing insofar as the allotted 2D volume 22 can be subdivided to include smaller 2D volumes 22*a*, 22*b* at points located away from the main aperture. These points are typically located closer to the driver. An internal 2D volume 22*a* can be isolated within the main 2D volume 22 fabricated internally between the interior and exterior enclosures 14*a*, 14*b* during production. The internal 2D volume (2DV2) 22*a* can have an individual aperture 24*a* associated with that volume 22*a* and is provided to improve the response at higher acoustic frequencies. This subdivision of the 2D volume 22 is typically used to adjust the response of a full range driver. Alternatively, an external 2D volume 22*b* (2DV2) can be affixed to an outside surface of the internal enclosure 14*a* of the 3DV1 volume 20 to enable fine tuning of the speaker in the field or for production tuning for inclusion within the main 2D volume 22. The external 2D volume 22*b* has its own respective individual aperture 224*b*. This external 2D volume 22*b* can also be made having a variety of different thicknesses that can be optionally selected to provide added flexibility in tuning.

There has been a lack of understanding of turbulent environments among workers in the engineering community which has hindered innovation in the loudspeaker industry, which relies on a loudspeaker paradigm established in the early 20th century. The acoustic adapter of the present invention provides 21st century insights which can be employed with audio products that are being made smaller and thinner, for which the old rules cannot apply or be forced. The present acoustic adapter can be used to provide accurate sound reproduction to all loudspeaker systems whether single driver or multi-way loudspeakers using subwoofer, woofer, midrange and tweeter.

Figure 2A:
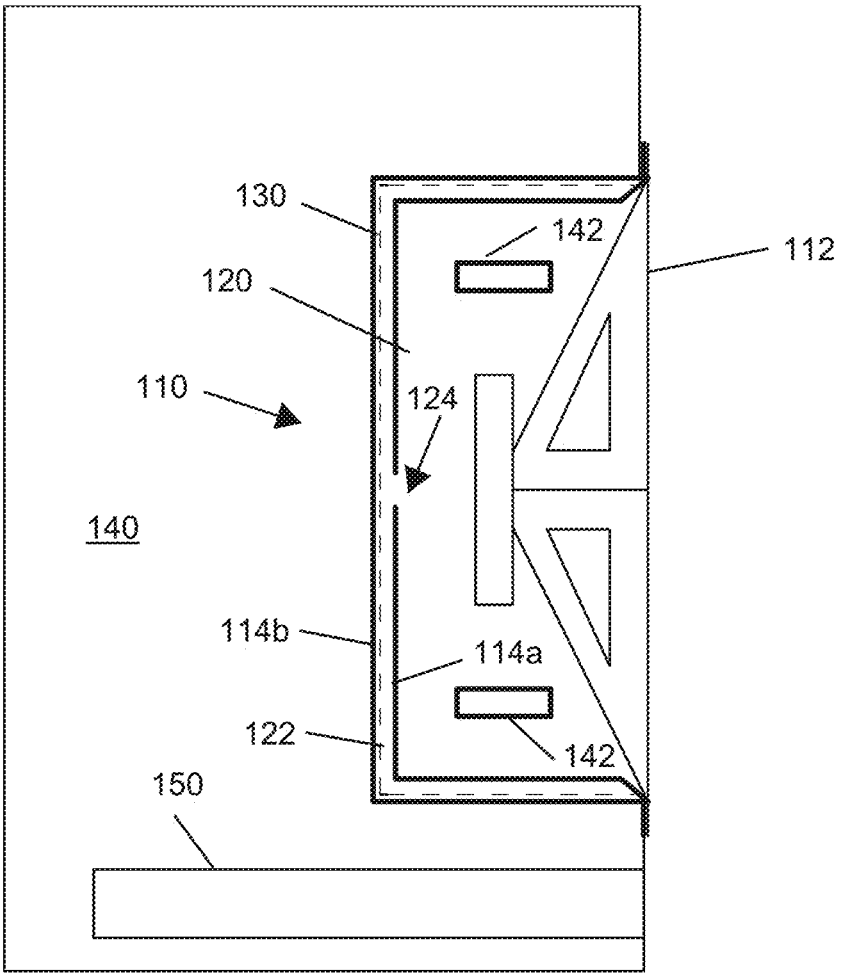
FIGS. 2A and 2B are side sectional views of a speaker driver with an acoustic adapter in accordance with first and second additional exemplary embodiments of the present invention.
Figure 2B:
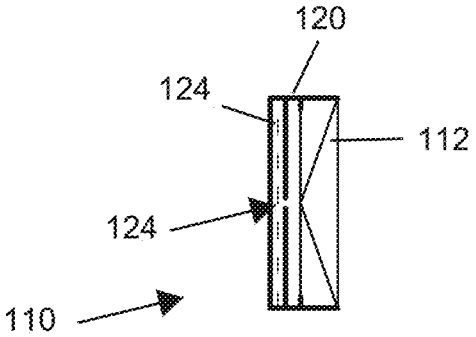

Alternate exemplary embodiments are shown in FIGS. 2A and 2B. An acoustic adapter 110 is provided, having a housing with a deeper configuration in this embodiment for enclosing a speaker driver 112. In this embodiment, the speaker driver 112 is preferably a loudspeaker operating in low frequencies or in a full range. The adapter 110 of this embodiment also includes an interior enclosure 114*a* and an exterior enclosure 114*b* in accordance with the description given herein above. The interior enclosure 114*a* substantially surrounds the back of a speaker driver 112 for defining a predetermined three-dimensional interior volume 120 around the back of the speaker driver 112 to thereby act as a vibration dampener. The exterior enclosure 114*b* has a configuration that corresponds to a configuration of the interior enclosure 114*a* (in this case, rectangular) and is spaced apart from the interior enclosure 114*a* to define a restricted two-dimensional volume 122 outside the three-dimensional interior volume 120.

As especially shown in FIG. 2A, the interior 3D volume (3DV1) 120 is defined immediately behind the diaphragm of the speaker driver 112. This volume 120 acts as a damped spring in conjunction with the associated 2D volume (2DV) 122. This damping determines the quality (Q) of the diaphragm vibrations. The 3D volume 120 is determined empirically by the application with more damping required if a lower range of frequencies are desirably produced. Typically, the main determinate of the 3D volume 120 is the diaphragm size and shape. Preferably, the diaphragm is round, but alternatively, oval and square shape drivers can be employed. Suitable acoustic adapter 110 shapes can be implemented for any corresponding diaphragm shape. The (3DV1) 120 volume can be minimized in applications in products requiring minimum thickness with Q being controlled by the density of the (2DV) 122 boundary friction surfaces.

As also shown in FIG. 2A, friction enhancing open cell foam 130 is used to coat and line the inner surface exterior enclosure 114*b*. In the preferred embodiment, the foam 130 can typically occupy 50% of the 2DV 122. An aperture 124 is provided in the interior enclosure 114*a*, preferably centrally located behind the speaker driver 112 and along the central axis of the speaker 112. The aperture 124 has an opening size and shape that determines the initial velocity into the open air space of the 2DV 122. The opening area of the aperture 124 is empirically determined by frequency range of application and volume capability of driver diaphragm. Higher frequencies generally require a smaller aperture area while large volume low frequency applications require a larger aperture area.

With further reference to FIG. 2A, the 2DV 122 is occupied by friction enhancing foam 130 and an air space. This 2D volume 122 can vary in dimensional area (x and y) but is restricted in the z dimension. The 2D area (x/y) is not restricted to a particular dimension or shape but typically conforms to the dimensions of the driver for proper installation. In other words, the 2D area is circular for a circular driver, or respectively oval or rectangular, etc. The height (z) or volume dimension is restricted to a minimal fixed value that is constant over the entire 2D area. This minimal value precludes this 2D volume 122 from becoming a resonant 3D volume. Determination of this dimension is again associated with application with lower frequencies requiring a larger z value relative to the x/y or circular area dimension. At present the x/y dimensions for 2DV 122 are determined by driver size and shape and the empirically determined z dimension is chosen for proper final Q value.

As also shown in FIG. 2A, a second three-dimensional volume (3DV2) 140 is defined outside an exterior surface of the exterior enclosure 114*b*. The 3DV2 140 is an optional volume that establishes the product dimensions and allows for increased low frequency output using a low frequency port or duct 150. The port 150 is typically open to the front of the speaker and conducts pressure information from inside the speaker cabinet to the outside, thereby providing an additional boost to the bass response. The second three-dimensional volume 140 is preferably a larger volume than the 3DV1 120 and thereby defines additional regulated air pressure. Unlike a conventional ported enclosure, the pressure at its boundaries is that of the isothermally regulated 3DV1 120.

As additionally shown in FIG. 2A, one or more dynamic pressure isolators (DPIs) 142 are formed in the interior and exterior enclosures 114*a*, 114*b*. The DPI(s) 142 provide communication of the regulated pressure between the second three-dimensional volume (3DV2) 140 to the three-dimensional volume (3DV1) 120 to magnify low frequency output in conjunction with the port. The dynamic pressure isolator openings 142 are positioned and sized to allow proper communication between (3DV1) 120 and (3DV2) 140 for isothermal pressure management of the entire closed system. When the duct throat is located adjacent to a boundary layer, the output pressure is consistent with frequency. The duct in this configuration will output a broad range of low frequencies not a resonant peak as a fixed volume enclosure with minimal driver excursion. (The driver diaphragm experiences a minimal excursion at a single frequency in conventional bass systems.)

The dimensions and position of the acoustic adapter 110 vary to accommodate the associated driver 112, based on the application and the intended range of frequencies. The acoustic adapter 110 provides optimal broadband isothermal regulation of the velocity of a piston of a speaker driver 112. In some embodiments, the utilization of space may require that the 3DV1 120 is not immediately behind the driver and is channeled to an offset acoustic adapter 110. Such channeling is a part of an acoustic adapter 110 such as needed in a car, TV, etc.

The following specifications have been empirically determined to provide excellent results for the low frequency embodiment depicted in FIG. 2A. For an 8-inch driver with a 6-inch diaphragm area:

Enclosed 3DV2: 0.185 cu ft.
Enclosed 3DV1: 0.049 cu ft.
Square area 2DV: 28 sq in.
Thickness 2DV: 0.75 in.
Thickness of foam: 0.25 in.
Density of foam: 32 kg/m3
Air space above foam: 0.5 in.
Aperture opening: 0.75 in.

The port length in the example is 13 inches. It is curved to fit the small enclosure dimensions of 8"×10"×4". The port diameter is 1.5 in. As an example of the ability to displace 3DV2 volume with little effect is that the port length was determined with most of the tube located outside of the 3DV2 volume. When the appropriate length was determined the graph did not change when all of the port was now in the box. The port displaces 3DV volume and the 2DV volume compensates for this.

As shown FIG. 2B, in an embodiment in which the size and space is greatly reduced, the required choice of a small flat driver 112 would allow for a flattened acoustic adapter 110 that would have a very small 3DV1 volume 120 and would not require lower frequency output. The 2DV 122 can be mounted very close to the flat driver 112 to allow cone motion and pressure entry into the 2DV 122 through the smaller aperture 124. The 2DV 122 can be configured to contain and damp the output for optimal Q.

The following specifications have been empirically determined by the inventor to provide excellent results for the high frequency embodiment depicted in FIG. 2B. For a 1-inch silk dome tweeter:

Enclosed 3DV1: 0.098 cu in.
2DV area: 1.57 sq in.
2DV height: 0.125 in.
Foam thickness: 0.0625 in.
Foam density: 32 kg/m3
Air space above foam: 0.0625 in.
Aperture opening; 2 mm (0.060 in.)

Figure 4A:
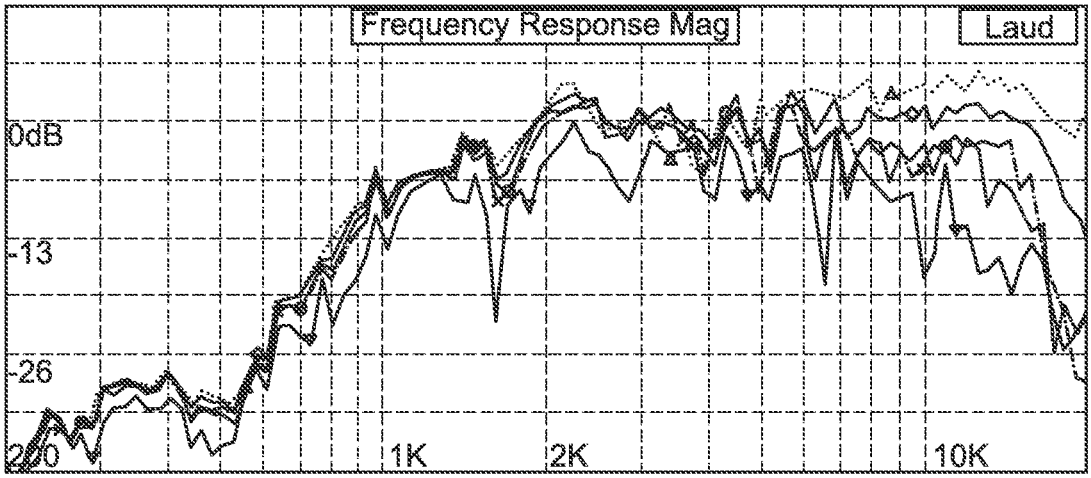
FIGS. 4A and 4B are graphs indicating on-axis and off-axis audio fidelity for a high frequency speaker according to FIG. 2B when respectively used without the acoustic adapter and with the acoustic adapter, in accordance with the first additional exemplary embodiment of the present invention.
Figure 4B:
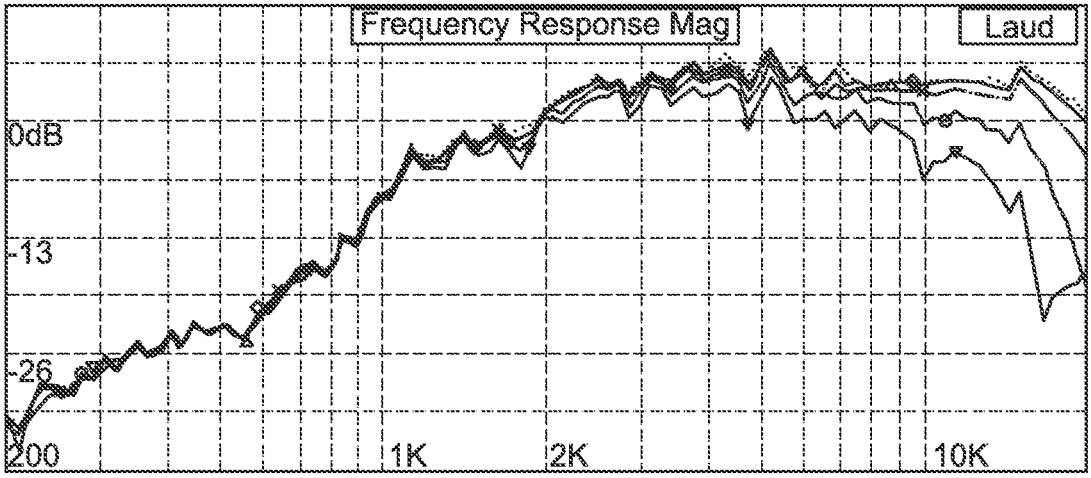

FIGS. 4A and 4B are graphs indicating on-axis and off-axis audio fidelity for the speaker 112 when respectively used without the acoustic adapter 110 and with the acoustic adapter 110.

Figure 3A:
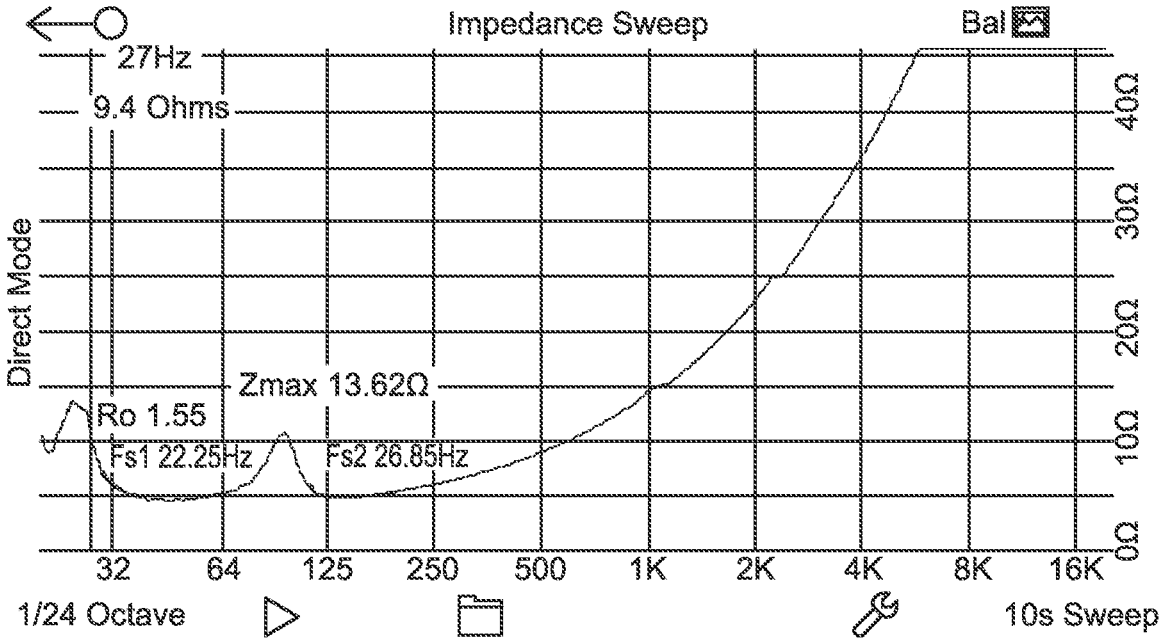
FIGS. 3A and 3B are graphs indicating the impedance for a low frequency speaker according to FIG. 2A when respectively used without the acoustic adapter and with the acoustic adapter in accordance with the second additional exemplary embodiment of the present invention.

FIG. 3A shows the system impedance without the acoustic adapter 110. The graph indicates the lowest impedance at 7.8 ohms with the peaks at and above 20 ohms. The driver DC impedance is 4 ohms. There is little control by the signal of the bass quality with this system as it is too resonant (reactive) with booming bass. The Q of this system is well above 1.

Figure 3B:
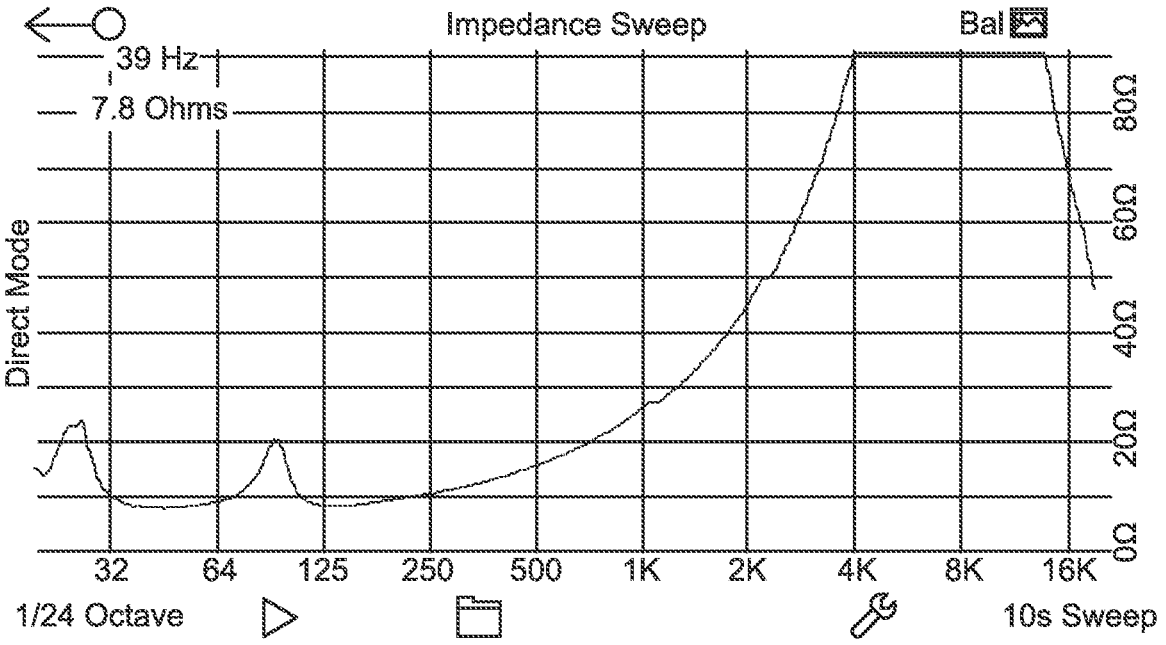

FIG. 3B depicts the impedance of the same system used with the acoustic adapter 110. The graph indicates the lowest impedance is near 4 ohms and the highest peaks are at and above 10 ohms. The signal is now controlling the driver with little resonance or reactive impedance to cause booming sounds. This indicates critical damping between 0.707 and 1 is achieved for the entire broadband impedance.

FIGS. 4A and 4B are graphs indicating on-axis and off-axis audio fidelity for the high frequency speaker 110 according to FIG. 2B when respectively used without the acoustic adapter 110 and with the acoustic adapter 110.

FIG. 4A indicates performed of the speaker 110 without the acoustic adapter 110 and illustrates diaphragm breakup due to back-pressure on the speaker diaphragm. This problem gets even worse when multiple frequencies are present simultaneously. The on axis response is not smooth and the off axis response is very irregular.

FIG. 4B illustrates smoother on and off axis frequency response when the acoustic adapter 110 is used. The improved dispersion and flatness of the response is due to isothermal pressure management and the lack of back-pressure on the speaker diaphragm.

Figure 5:
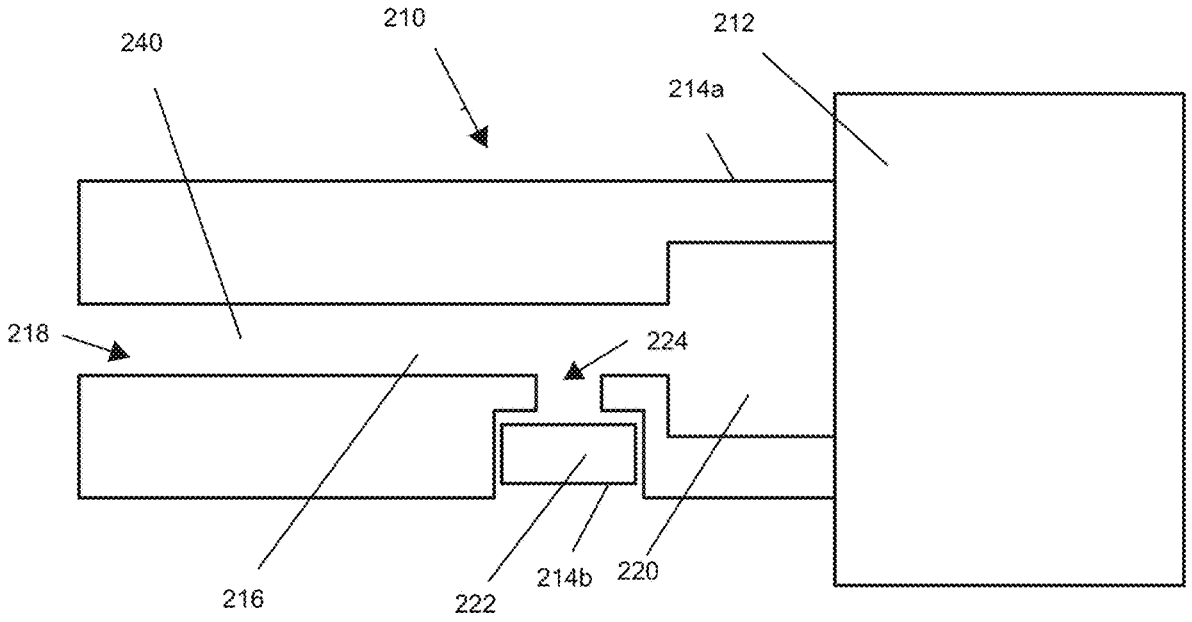
FIG. 5 depicts a balanced armature acoustic adapter for use with a hearing aid in accordance with a further exemplary embodiment of the present invention.

FIG. 5 depicts a balanced armature acoustic adapter (BAAA) 210 in accordance with a further exemplary embodiment of the present invention. This embodiment can be used in conjunction with a BA (balanced armature) driver 212 as a hearing aid. The balanced armature driver 212 resides within a designated first enclosure 214*a* (preferably rectangular) and delivers the sound to the ear through a duct or tube 216. The tube 216 carries the sound from the BA driver 212 to the ear canal, located at the end 218 of the tube 216. Prior to entering the tube 216 the sound waves exist in a first three-dimensional volume 3DV1 220. This volume 220 is indicated in the other drawings as that volume 20 immediately behind the speaker driver 12. As a composite wave enters the tube 216 there will be resonances associated with the length of the tube 216. As the sound travels through the tube 216 into a virtual second three-dimensional volume 3DV2 240 on the back portion of the tube 216 that terminates at the end 218, the main audio signal acts upon the driver 212 but reactive pressures develop as the driver 212 moves. A two-dimensional volume 2DV 222 is located downstream from the BA driver 212, in parallel with the tube 216, and causes the weaker reactive pressures in the tube 216 to be managed by isothermal vertical heat dissipation in that 2D volume 222. The 2D volume 222 is defined by a second enclosure 214*b* affixed to the tube 216 in parallel at a location downstream of the balanced armature driver, so that the second enclosure 214*b* defines a restricted two-dimensional volume (2DV) outside the three-dimensional interior volume 220. An aperture 224 is formed in the side of the tube 216 for admitting sound into the two-dimensional volume 222, for managing the weaker reactive pressures in the tube 216. The ear is located at the opposite end 218 and seals the tube 216 providing the final acoustic load for the driver 212.

ADDITIONAL INFORMATION

Additional description information is provided herewith to further explain the present understanding of the operative physics underlying the present invention. The function of any machine is to do work and that work is most efficient if it is free from the effects of any work completed on a prior cycle. The loading of the machine should only be influenced by the work in progress not residual loading from a prior event. This general description applies to any system requiring high efficiency and low distortion relative to the controlling input. This is an aspect of entropy as described in physics. The description below is the method required to achieve a proper entropic condition for the loudspeaker piston. The conditions for proper loudspeaker operation are the same for all frequencies associated with audible sound reproduction or reinforcement when low distortion and wide dynamic range are considered.

Available Volume (3DV) (x+y+z) is the term relative to that volume allowed behind the diaphragm when the driver is installed. This volume needs to be sealed for its function to be realized as it also isolates the front and rear dynamic pressure changes. Currently most products do not focus on this volume and engineers allow only that required for physically mounting the driver. In most cases this also isolates the front and rear of the diaphragm to avoid acoustic isolation. Those that do rely on the available volume use electronic processing in an effort to overcome the limitations. The problems that cause limitations are physical and attempts to overcome these by electronic processing cannot address the issues.

The 3DV allowed is a variable not available to the manufacturer of the speaker driver. As the driver may be used in a variety of ways it is desired to make available to the designer of a final audio product a cost effective part as a simple solution for a quality sound. An external acoustic adapter 110 would allow a loudspeaker's inclusion as a part with predictable audio performance of high quality for the desired frequency range.

A two-dimensional volume (2DV) is created when the depth (z) is restricted while the x and y dimension are expanded to create the required area for the 2DV. The 3DV allowed above creates "three-dimensional turbulence" (3DT). The terms 3DT and 2DT are relative to the available volume in which turbulence is created when a static air volume is disturbed by an applied dynamic force. In this case a loudspeaker driver operated by an electrical voltage causes this dynamic volume disturbance in the 3DV. Typically the acoustic energy created by these dynamic forces includes many frequencies simultaneously. The acoustic wavelengths associated with the electronic signals input vary considerably. The forces created vary relative to intensity and wavelength, all of which cause pressure variations that oppose the motion of the driver's diaphragm. These opposing forces alter the velocity of the diaphragm causing unavoidable distortions relative to both intensity and frequency. 3DT is created in this situation causing unpredictable dynamic pressures that vary with program material and volume.

2DT is created when these dynamic forces are introduced into an attached volume with a restricted depth (z). The 2DV volume is physically attached to the 3DV and communicates via of an aperture of designated dimension. The aperture, typically circular, allows pressure waves to enter the 2DV and create turbulence within the narrow volume. The objective in creating this 2DT is that it is restricted to its boundary layers wherein friction from the foam material dissipates the acoustic energy as heat. The turbulence created in this restricted 2DV volume is coherent and dissipates heat within its available area. Friction can be enhanced with a rough surface boundary layer or application of a material to enhance vorticity. The density of this material as it relates to air flow is an additional variable in turbulence creation. An open air space above the friction material must be maintained for proper generation of 2DT. A properly designed 2DV maintains the 3DV pressure (via this isothermal thermodynamic model) as laminar allowing the diaphragm to track the velocities established by the program source. The boundary layers of the 3DV maintain proper acoustic pressure termination for the broadband signal. The action due to heat dissipation within the 2DV creates a virtual 3DV volume. The ratio of 2DV required for a given 3DV is typically related to the square area of the driver's diaphragm. The 3DV does not have to be exact but must be relatively small to communicate the dynamic pressure details to the adjacent 2DV. The 2DV depth (z) and aperture dimension will vary relative to a driver's electro-mechanical properties and other potential variables.

The present invention incorporates "The Five D's of Radical Improvement With 2DT":

Distortion—low

Dynamic Range—high

Dispersion—wide

Depth—deep

Dimension—broad

3D+2D=Isothermal Management of Driver Enclosed Pressure

The 3D volume is characterized as that available behind the diaphragm. This volume is very limited relative to sound wavelengths and intensity in the ambient. In this limited volume application the 3D volume available is irrelevant when communicating with an isothermally governed 2D volume. The two-dimensional turbulence created within the volume is restricted to its boundary walls. Along these boundaries heat is generated by coherent vortices and maintained throughout dissipation. The availability of appropriate square area within the 2D volume in which vorticity can be increased is vital to pressure management within the 3D volume. The reactive coherent turbulence/dissipation created within the reactive 2D volume isothermally optimizes the associated loading pressures for the electro-mechanical parameters of a driver. This loading method accomplishes the requirement of managing the enclosed pressure as related to wavelengths and their intensity. Isothermal pressure management is the proper method for broad bandwidth pressures associated with audio signals. The solution appears complex and in reality it is. The details of vorticity generation in a 2D environment are complex but can be explained in relatively simple terms. Pressure energy introduced into the 2D volume immediately generates individual vortex patterns that independently combine as a coherent vortex. The coherent vortex regenerates as long as energy is introduced but only allows new energy to combine when its sign is in agreement. This admission activity continues while existing energy within the main coherent vortex dissipates as heat along the boundary layers associated with the 2D (turbulent) volume. The volume restriction in the third (z) dimension forces this action. The coherency of the main coherent vortex(s) assures that pressure in the 3D environment is maintained laminar (non-turbulent) relative to the signal requirements. Diaphragm velocity is severely impaired (distorted) when motion is restricted due to unmanaged pressure. In a mechanical system this could be represented as a rotating mass that accepts external assistive rotational input when it is at an appropriate rate (sign) relative to the real time speed of the mass. It is considered coherent when the input would stimulate rotation as opposed to slowing it down. If pressure input into the 2D volume does not achieve coherence throughout the broadband signal input then a random back pressure will be felt at the diaphragm. This alters diaphragm velocity therefore creating audible distortion. The goal is to provide Critical Damping (CD) for the driver's frequency range.

Audio Fidelity Wheel

A creative description of the process is a frequency, pressure, velocity (FPV) wheel that maintains its roundness as a function of FPV normality. A perfect circle of specific diameter represents the linear real-time broadband output of an ideal acoustic transducer. The diameter of the wheel is a function of pressure level relative to the input signal demands. If the circle deviates at any point either increasing or decreasing in diameter along its circumference distortion of the signal is evident at that point. If the average level is increased or decreased the circle diameter should increase or decrease but maintain its roundness. Variations at frequency points that indicate increases or decreases in diameter demonstrate that the velocity of the diaphragm is varying relative to the signal input. This is due to pressure variations created as the diaphragm motion dynamically reduces or increases the static enclosed volume. The static volume simply cannot accommodate the pressure variations associated with broadband audio without affecting the velocity and position of the diaphragm relative to the signal demands. The FPV wheel graphically illustrates deviations from the desired velocity. A continuous circumference of any diameter indicates a linear relationship with the static level. A circumference with deviations either larger or smaller than the static level indicates changes in velocity that are not reflective of the input signal. These changes are due to random pressure increases or decreases that react with the ongoing diaphragm motion. Very unpredictable distortion components develop as a result with frequency content and level being the direct contributors. In some instances this energy is viewed as stored energy in that it represents energy that is not part of the work currently being performed by the driver. Entropy, a term used to characterize energy lost in a physical operation, depicts situations in which work performed during a previous cycle should not affect that currently being executed. The previous work must have a means of being dissipated. The work creates pressure behind the diaphragm that must be managed as a function of the composite energy present. The fact that pressure increases create heat within the volume especially along the boundary layers means that a means of pressure management is needed. Pressure management at any given instant means that the wavelets present within the composite are terminated coherently. Coherent termination defines a point wherein the pressure associated with each wavelength has a supportive role in loading the diaphragm only during its period of existence. This coherent termination is provided as a function of an adjacent volume attached such that it sees total boundary layer pressure but primarily as a two-dimensional volume. This volume will generate turbulence within that is captured and forced via of a high friction boundary layer to modulate the pressure relative to frequency and intensity. This creates a coherent loading of the diaphragm in both directions of piston motion as the negative and positive positions of the diaphragm are started from a proper pressure bias.

(AA) Acoustic Adapter=V1+V2

All loudspeaker drivers have electro-mechanical parameters that define their operation in a closed volume. These parameters primarily focus on low frequency performance. The goal for proper operation of the driver is critical damping for its full bandwidth. The transition from the lower range to higher ranges is progressive. The range depends on the drivers' intended use and with the 2DV function this includes the full audio range. Focusing on the woofer which in conjunction with a tweeter covers the entire audio range. The woofer determines the minimum dimensions for the baffle incorporating both drivers. For simplicity assume a rectangular enclosure is to be constructed. The woofer is assigned the task of reproducing the longest wavelengths therefore an acoustic adapter should be adapted to accommodate its diameter. The depth of 3DV1 in conjunction with proper 2DV parameters is to critically damp the driver over its operating range. The diameter of the acoustic adapter can include a folded 2DV to increase the area of the 2DV. The aperture connecting V1 and V2 has a diameter that at this time is determined empirically for the associated driver. Other parameters to include foam density and air space height are determined empirically. V1 can vary considerably with V2 compensating to provide critical damping. Requirements for adjustments of V1 can be due to application (product) dimension restrictions. V2 can compensate for a wide range of V1 restrictions to maintain critical damping of the driver. V1 is the volume demanding laminar flow of pressure information that replicates the input signal. This volume will encompass boundary layers that remain a termination for the full bandwidth of the signal. This is possible due to the vorticity occupying V2 which dissipates varying pressures within as heat. This dissipation is the result of eddies combining for a coherent pattern of heat release at the boundaries. The coherent rotating vorticity is maintained with newly introduced information when like polarities are established within V2. Isothermal regulation of pressure is established as a result of this action. The dominate energy of the compound broadband wave establishes the primary dissipation rate in real time. This energy is a matrix of wavelengths and levels of the signal and results in infinite combinations possible. The area of V2 should allow harvesting of the required vorticity patterns for these combinations.

2D Turbulence Abstract

In physical systems, a reduction in dimensionality often leads to exciting new phenomena. Here we discuss the novel effects arising from the consideration of fluid turbulence confined to two spatial dimensions. The additional conservation constraint on squared vorticity relative to three-dimensional (3D) turbulence leads to the dual-cascade scenario of Kraichnan and Batchelor with an inverse energy cascade to larger scales and a direct entropy cascade to smaller scales. Specific theoretical predictions of spectra, structure functions, probability distributions, and mechanisms are presented, and major experimental and numerical comparisons are reviewed. The introduction of 3D perturbations does not destroy the main features of the cascade picture, implying that 2D turbulence phenomenology establishes the general picture of turbulent fluid flows when one spatial direction is heavily constrained by geometry or by applied body forces. Such flows are common in geophysical and planetary contexts, are beautiful to observe, and reflect the impact of dimensionality on fluid turbulence.

Broadband Isothermal Loading (BIL) via 2DT for Loudspeaker

Isothermal loading provides dynamic volume expansion deemed a Virtual Volume (VV) established from a fixed volume, a virtual volume represents in real time the internal pressure required to properly load the driver at any given frequency and level. In essence the driver diaphragm always achieves the proper velocity due to isothermal pressure management afforded by viscous heat dissipation within the 2DV. In containing the entire process within the established volume, the enclosure acts as a fluid transmission operating in real-time with continuing dynamic loading of all the elements of the compound energy.

Potential 3DV1+3DV2+2D

A potential option for the 3DV1 volume is for the adapter to utilize additional 3D volume within its product structure. This volume would have an established passive path to gain additional 3DV2 volume which would allow for expansion of low frequency signals. This additional volume could be created with an offset area acoustic pathway with the adjustment to be set for the specific 3DV2 volume available. This volume must be fully enclosed and isolated from the front of the driver. Additional research will determine the effectiveness of this approach to assure low frequency level demands can be met for the application. The acoustic pathway would only be seen below a certain frequency so as not to affect 2DT turbulence activity in higher ranges. The 3DV2 volume would require no additional damping material and its boundary layers would terminate all wavelengths communicated to it. The 2DV volume would establish the dynamic expansion of isothermal regulation while the external 3DV2 volume is under its influence and boundary layers of both 3D volumes remain related. A low frequency duct can be accessed from the larger 3DV2 volume allowing for broadband low frequency output at higher levels than that afforded by the smaller controlling 3DV1 volume. The 3DV2 volume remains acoustically isolated from the ambient. The 2D volume is located close to the diaphragm and remains the primary target for the pressure energy even when acoustically connected to the 3D V2 volume. This allows the isothermal regulation to be associated with all of the energy but with relaxed damping in the 3DV2. This may be necessary to establish critical damping in the low frequency range where close location of 2DV volume in the acoustic adapter might over damp these ranges. All volumes have a static pressure that is identical with the ambient pressure. Diaphragm motion approaching the lower audio range causes an increase in pressure in the 3DV1 volume. This is followed by almost instantaneously control of that volume by turbulence in the 2DV volume. The turbulence in the 2DV volume establishes heat dissipation in that volume that manages the flow in the 3DV1 volume as laminar. Pressure control in the 3DV2 volume is maintained in the lower frequency ranges, below a point established by a port area open to the 3DV2 volume. Frequencies above that established point ignore the 3DV2 volume and interact only with the 3DV1 and 2DV volumes. The 3DV2 volume acts as an air reservoir to allow more air to exit the port associated with that volume. This port is not tuned to a resonant frequency but must be of the appropriate dimension to carry the lowest waves at the appropriate velocities. All volumes are dynamically pressure modulated when the driver diaphragm is in motion otherwise all volumes are at ambient pressure.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

What is claimed:

1. An acoustic adapter comprising:

an interior enclosure for substantially surrounding a back of a speaker driver and for defining a predetermined three-dimensional interior volume (3DV1) around the back of the speaker driver to thereby act as a vibration dampener;

an exterior enclosure having a configuration that corresponds to a configuration of the interior enclosure and spaced apart from the interior enclosure to define a restricted two-dimensional volume (2DV) outside the three-dimensional interior volume;

an aperture formed in the interior surface of the enclosure for admitting sound into the two-dimensional volume; and a foam material received within the two-dimensional volume (2DV) for at least coating an inner surface of the exterior enclosure, to provide a frictional surface for damping the sound admitted into the two-dimensional volume.

2. The acoustic adapter of claim 1, further comprising a second three-dimensional volume (3DV2) outside an exterior surface of the exterior enclosure.

3. The acoustic adapter of claim 2, wherein the second three-dimensional volume (3DV2) is a larger volume than the predetermined three-dimensional volume (3DV1) and thereby defines a more regulated air pressure.

4. The acoustic adapter of claim 3, further comprising at least one dynamic pressure isolator formed in the interior and exterior enclosures, for providing communication of the regulated pressure between the second three-dimensional volume (3DV2) to the predetermined three-dimensional volume (3DV1) to magnify low frequency output in conjunction with a port.

5. The acoustic adapter of claim 1, wherein the foam material is friction-enhancing open cell foam that lines the inner surface of the exterior enclosure.

6. The acoustic adapter of claim 1, wherein the foam material substantially occupies 50% of the two-dimensional volume.

7. The acoustic adapter of claim 1, wherein the aperture is centered behind the speaker driver on the interior enclosure.

8. The acoustic adapter of claim 1, wherein the aperture has an aperture size and aperture shape selected according to a frequency range of the speaker driver, wherein the aperture size comprises a larger portion of the interior surface when used with a lower frequency speaker driver and a smaller portion of the interior surface when used with a higher frequency speaker driver.

9. The acoustic adapter of claim 1, wherein the interior and exterior enclosures have a configuration selected from round, oval, square, or rectangular.

10. The acoustic adapter of claim 1, wherein the two-dimensional volume has a dimensional area (x, y) that conforms to dimensions of the speaker driver and a volume dimension (z) restricted to a fixed value selected according to a frequency range of the speaker driver, wherein a larger volume dimension (z) is selected for a lower frequency speaker driver and a smaller volume dimension (z) is selected for a higher frequency speaker driver, wherein the volume dimension (z) is selected to provide a desired sound quality (Q).

11. The acoustic adapter of claim 1, wherein the two-dimensional volume comprises at least one additional subdivided two-dimensional volume having a respective individual aperture, wherein the at least one additional subdivided two-dimensional volume corresponds to a selected predetermined frequency.

12. The acoustic adapter of claim 11, wherein the at least one additional subdivided two-dimensional volume and its respective individual aperture are located at a respective point away from the aperture formed in the interior surface of the enclosure.

13. The acoustic adapter of claim 11, wherein the additional subdivided two-dimensional volume having a respective individual aperture is an internal two-dimensional volume fabricated internally in between the interior and exterior enclosures.

14. The acoustic adapter of claim 11, wherein the additional subdivided two-dimensional volume having a respective individual aperture is an external two-dimensional volume affixed to an outside surface of the internal enclosure.

* * * * *